US009353620B2

(12) United States Patent
Gisolf et al.

(10) Patent No.: US 9,353,620 B2
(45) Date of Patent: May 31, 2016

(54) DETECTION OF PERMEABILITY ANISOTROPY IN THE HORIZONTAL PLANE

(71) Applicant: Schlumberger Technology Corporation, Sugar Land, TX (US)

(72) Inventors: Adriaan Gisolf, Houston, TX (US); Peter Hegeman, Stafford, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 68 days.

(21) Appl. No.: 13/793,901

(22) Filed: Mar. 11, 2013

(65) Prior Publication Data

US 2014/0250998 A1 Sep. 11, 2014

(51) Int. Cl.

| | |
|---|---|
| ***E21B 49/08*** | (2006.01) |
| ***E21B 49/10*** | (2006.01) |
| ***E21B 47/06*** | (2012.01) |
| ***E21B 49/00*** | (2006.01) |

(52) U.S. Cl.
CPC ..... *E21B 49/008* (2013.01)

(58) Field of Classification Search
CPC ..... E21B 49/00; E21B 49/008; E21B 49/10
USPC ..... 73/152.01–152.62
See application file for complete search history.

(56) References Cited

U.S. PATENT DOCUMENTS

| | | | | |
|---|---|---|---|---|
| 2002/0046835 | A1* | 4/2002 | Lee et al. | 166/250.01 |
| 2003/0094040 | A1* | 5/2003 | Proett et al. | 73/152.05 |
| 2005/0194134 | A1 | 9/2005 | McGregor et al. | |
| 2006/0042371 | A1 | 3/2006 | Sheng et al. | |
| 2006/0241867 | A1* | 10/2006 | Kuchuk et al. | 702/13 |
| 2008/0221800 | A1 | 9/2008 | Gladkikh et al. | |
| 2010/0274490 | A1 | 10/2010 | Gok et al. | |
| 2011/0094733 | A1 | 4/2011 | Proett | |
| 2013/0205886 | A1 | 8/2013 | Hegeman et al. | |

OTHER PUBLICATIONS

Goode, et al., "Permeability Determination With a Multiprobe Formation Tester", SPE 20737—SPE Formation Evaluation, vol. 7 (4), 1992, pp. 297-303.

Onur, et al., "A Novel Analysis Procedure for Estimating Thickness-Independent Horizontal and Vertical Permeabilities From Pressure Data at an Observation Probe Acquired by Packer-Probe Wireline Formation Testers", SPE 148403—SPE Reservoir Evaluation & Engineering, vol. 14 (4), 2011, pp. 477-492.

Zimmerman, T. et al., "Application of Emerging Wireline Formation Technologies", OSEA 90105—Offshore South East Asia Conference, Singapore, Dec. 4-7, 1990, 13 pages.

International Search Report and Written Opinion issued in PCT/US2014/022410 on Jun. 26, 2014, 10 pages.

* cited by examiner

*Primary Examiner* — Peter Macchiarolo
*Assistant Examiner* — Anthony W Megna Fuentes
(74) *Attorney, Agent, or Firm* — Kenneth L. Kincaid

(57) ABSTRACT

A method for detection of permeability anisotropy, having steps of positioning a formation testing tool, conducting a series of three flow tests with the testing tool wherein a first test is a four drain flow test, a second test is a pair of opposite drains flowing on diametrically opposite sides of the formation testing tool and a third test is a second pair of opposite drains flowing on opposite drains different than the second test; determining one of horizontal permeability and horizontal mobility, determining one of orthogonal components of horizontal permeability and horizontal mobility based on the measured flow response and determining a direction of the orthogonal components of the horizontal permeability or horizontal mobility with respect to the orientation of the formation testing tool based on a measured flow response.

10 Claims, 20 Drawing Sheets

DETECTION OF PERMEABILITY ANISOTROPY IN THE HORIZONTAL PLANE

CROSS-REFERENCE TO RELATED APPLICATIONS

None.

FIELD OF THE INVENTION

Aspects relate to testing of geological formations. More specifically, aspects relate to detection of permeability anisotropy in the horizontal plane of a geological formation using a single-packer system.

BACKGROUND INFORMATION

In petroleum reservoirs, permeability affects the overall production capability of a wellbore. Permeability can vary greatly based upon several factors, including the overall type of material that the wellbore penetrates. Permeability can also change in a wellbore as the wellbore progresses through increasing lengths. Vertical permeability anisotropy refers to the change of permeability as the wellbore penetrates layer upon layer in the geological stratum.

Permeability, however, may also change in the horizontal plane. Horizontal permeability anisotropy can be just as important, if not more important, to the petroleum well. Such horizontal plane anisotropy can affect the overall well output if the horizontal permeability components vary a great deal or if the anisotropy is located in specific areas of the geological stratum. Identification of such horizontal anisotropy, however, is difficult. There are currently no standardized tests to determine horizontal permeability anisotropy for geological stratum. In addition to the above, single-packer configurations or probe configurations have not been utilized to determine such horizontal permeability anisotropy.

Finding a statistically meaningful method to determine horizontal permeability anisotropy can provide large benefits for operators of well drilling equipment. If extreme variation of horizontal permeability components is found, such seemingly profitable payzones in formations may be discarded in favor of more productive formation features.

Such investigations can minimize needless drilling in remote areas, for example, if the need for such drilling would not provide dividends in light of the expanded costs of drilling. Investigations performed in high value wells, such as deep water ocean drilling, where costs can range in the millions of dollars per day, can have a significant impact on the overall return of drilling. In addition to the above, there is a need to be able to identify horizontal permeability anisotropy with downhole equipment, away from expensive laboratory tests used in conventional applications. Such field capable identification would be of significant benefit as no conventional applications exist that would quickly and reliably identify horizontal permeability anisotropic conditions in modem wellbores and well drilling.

SUMMARY

In one example embodiment, a method for detection of horizontal permeability anisotropy is disclosed comprising positioning a formation testing tool within a wellbore formed within a subsurface reservoir, conducting a series of three flow tests with the testing tool wherein a first test is a four drain flow test, a second test is a pair of opposite drains flowing on diametrically opposite sides of the formation testing tool and a third test is a second pair of opposite drains flowing on opposite drains different than the second test; determining one of horizontal permeability and horizontal mobility of the reservoir based on measuring a flow response of the subsurface reservoir one of at and adjacent to the flowing drains, determining one of orthogonal components of horizontal permeability and horizontal mobility based on the measured flow response; and determining a direction of the orthogonal components of one of the horizontal permeability and horizontal mobility with respect to the orientation of the formation testing tool based on a measured flow response.

In another example configuration, the method may be accomplish in the formation testing tool is configured with a single-packer module.

In another example embodiment, the method may be accomplished wherein the single packer has four symmetrically shaped drains to enable fluid communication with the subsurface reservoir.

In another example embodiment, the method may be accomplished wherein the method is performed in a sub-sea wellbore.

In another example embodiment, the method may be accomplished wherein the single-packer module is configured with two pairs of drains.

In another example embodiment, the method may be accomplished wherein the conducted series of three flow tests includes using a single-packer module in the downhole environment and expanding the single-packer module to the exterior sides the wellbore.

In another example embodiment, an article of manufacture is presented comprising: a non-volatile memory configured to perform a series of executable commands, wherein the executable commands are configured to perform a method for detection of permeability anisotropy, comprising: positioning a formation testing tool within a wellbore formed within a subsurface reservoir; conducting a series of three flow tests with the testing tool wherein a first test is a four drain flow test, a second test is a pair of opposite drains flowing on diametrically opposite sides of the formation testing tool and a third test is a second pair of opposite drains flowing on opposite drains different than the second test, determining one of horizontal permeability and horizontal mobility of the reservoir based on measuring a flow response of the subsurface reservoir one of at and adjacent to the flowing drains; determining one of orthogonal components of horizontal permeability and horizontal mobility based on the measured flow response, and determining a direction of the orthogonal component of one of horizontal permeability and horizontal mobility with respect to the orientation of the formation testing tool based on a measured flow response.

In another embodiment, the article of manufacture is configured wherein the formation testing tool is configured with a single-packer module.

In another embodiment, the article manufacture is configured wherein the single packer has four symmetrically shaped drains to enable fluid communication with the subsurface reservoir.

In another embodiment, the article of manufacture is configured wherein the method is performed in a sub-sea wellbore.

In another embodiment, the article of manufacture is configured wherein the single-packer module is configured with two pairs of drains.

In another embodiment, the article of manufacture is configured wherein the conducting a series of three flow tests includes using a single-packer module in the downhole environment and expanding the single-packer module to exterior sides of the wellbore.

DETAILED DESCRIPTION

Horizontal permeability anisotropy is a significant geological feature that affects the overall economic viability of a drilling operation. In conventional apparatus and methods, operators must make best case assumptions of horizontal permeability anisotropy. No conventional tests exist using downhole tools for quickly determining horizontal permeability anisotropy.

In wellbore completion, for example, new technologies such as single-packer systems may be used to isolate portions of wellbores for testing. Single-packer systems are ideal for such applications as these single-packer systems allow for easily transportable capability for downhole operations coupled with extensive holding/plugging capability.

Figure 1:
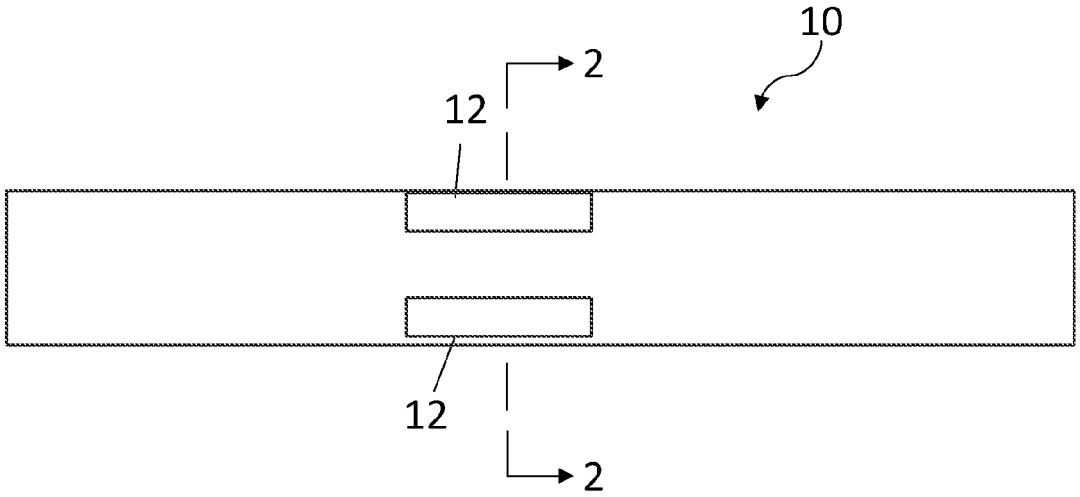
FIG. 1 is a front view of a four (4) port single packer module, according to aspects of the present disclosure.
Figure 2:
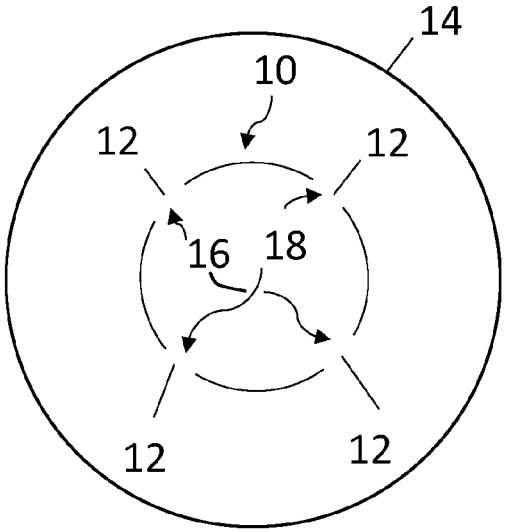
FIG. 2 is a cross-sectional view of the four (4) port single packer module of FIG. 1, according to aspects of the present disclosure.

For single-packer systems such a single packer 10 shown in FIGS. 1 and 2 disposed in wellbore 14), fluid is usually withdrawn from drains 12 (e.g., a first pair (16) of opposite drains 12 disposed on diametrically opposite sides of the single packer 10 and a second pair (18) of opposite drains disposed on diametrically opposite sides of the single packer 10) in the single packer 10 simultaneously. The drains 12 are located around the periphery of the single-packer system. The drains 12 may be different shaped, such as with circular holes or may be elliptical holes. The single-packer systems are deployed downhole in an unexpanded state and then subsequently expanded. The expansion may occur through use of a mechanical expansion system that has, for example, slats that expand and contract based upon the signals of an operator.

In some non-limiting single-packer embodiments for the present, for example, it is possible to withdraw fluid from two (2) drains located on diametrically opposite sides or portions of a single packer while the other two (2) drains are closed. In the context of the remaining specification, the two (2) drains that remain closed are considered observation drains. The two (2) flowing drains would be opposite each other as are static observation drains that are closed. The single-packer system may be configured, in some instances, such that the flowing and static observation drains can be switched. For example in a first test one (1) set of two (2) drains is flowing and the second set of two (2) drains is static. In the second test, the first original set of two drains that were flowing become static and the static drains become flowing drains. Such changes may be made by an operator located at the surface sending commands to the single-packer system to switch pump and valve configurations which operate the respective drains.

To help in identifying pressure readings in single-packer systems, high resolution pressure gauges may be used in conjunction with the single-packer apparatus. Such pressure gauges may be located at the entry of the drain to the single packer or may be located near the entry of the drain. To that end, a single pressure gauge may be placed in each drain of the single-packer apparatus or a single pressure gauge may be placed for a pair of drains.

Permeability determination with formation testing tools has received considerable attention in literature. In particular, the detection and quantification of permeability anisotropy in the vertical-horizontal plane, $k_v/k_h$ has been the subject of many studies. The detection and quantification of permeability anisotropy within the horizontal plane, however, has received no attention. Understanding such anisotropy is critical for optimum design of reservoir drainage patterns, secondary and tertiary recovery projects and stimulation treatments, to name but a few examples. Anisotropy within the horizontal plane usually creates three-dimensional anisotropy with vertical permeability differing from both components of horizontal permeability, $k_x$ and $k_y$. Aspects of the below described embodiments use a single packer for quantification of permeability anisotropy in the horizontal plane.

A numerical finite-difference simulation model was developed to study the formation-pressure response for flow from a four (4) drain source. The model allowed for three dimensional "3D" flow from an x-y-z rectangular reservoir grid with no-flow outer boundaries. A single-phase slightly-compressible fluid with constant fluid properties was used. The drains were modeled as infinite-conductivity oval-shaped sources on the side of the wellbore. Two cases were studied wherein drains were aligned with the principal directions of horizontal permeability, and drains oriented at 45 degrees with respect to the permeability. These two cases represent the two extremes of drain alignment with respect to horizontal anisotropy.

The model allowed the flow rate from each drain to be specified independently. Two cases were studied, the first where all four (4) drains flow at the same rate and the second being two (2) opposite drains flowing wherein the other two opposite drains are closed. The reservoir grid was very fine near the wellbore to approximate the circular wellbore shape and an oval drain shape. In the example, the smallest grid cells were 0.1 inch (0.253 cm) cubes. The wellbore was placed at the center of the formation, in both the a real (x-y) and vertical (z) directions.

To study the effect of anisotropy within the horizontal plane, the following test specific case test conditions were modeled: $q=10\ cm^3/s$ for 100 hours, $\phi=0.2$, $c_1=1.8e\text{-}5$ 1/psi, $r_w=4.25$ inch, $\mu=1$ cp, h=50 m, vertical well and mid-point of flowing interval centered vertically. Three cases were considered: 1) $k_x=k_y=10$ millidarcy; 2) $k_x=5$ with $k_y=20$ millidarcy; 3) $k_x=20$ with $k_y=5$ millidarcy. For all cases the effective horizontal permeability, given by $(k_xky)^{-5}$ was 10 millidarcy. All cases had vertical permeability $k_z=10$ millidarcy. The drains of a single-packer module were aligned with $k_x$ and $k_y$. It is noted that as long as the well is centered in the x-y plane, the results for anisotropic cases 2 and 3 are symmetric—for example, the pressure drop at the x-direction drains when $k_y>k_x$ is the same as that at the y-direction drains when $k_y<k_x$. Cases 2 and 3 are therefore redundant, therefore the results for cases 1 and 2 are illustrated and described.

$c_t$=total compressibility
h=formation thickness
$k_h$=horizontal permeability in the x- and y-directions of a 2D anisotropic formation
$k_v$=vertical permeability in a 2D anisotropic formation
$k_x$=horizontal permeability in the x-direction of a 3D anisotropic formation
$k_y$=horizontal permeability in the y-direction of a 3D anisotropic formation
$k_z$=vertical permeability (in the z-direction) of a 3D anisotropic formation
q=flow rate
$r_w$=wellbore radius
$\Delta P$=pressure change since start of test
$\Delta t$=time since start of test
$\mu$=viscosity
$\phi$=porosity For the purposes of this specification the term "anisotropy" refers to a variation of a property with the direction in which it is measured. For example, rock permeability is a measure of its conductivity to fluid flow through the pore spaces. Reservoir rocks often exhibit permeability anisotropy whereby conductivity to fluid depends on the direction of flow of the fluid. This is most often true when comparing permeability measured parallel or substantially parallel to the formation bed boundaries, which may be referred to as horizontal permeability, hereinafter defined $k_h$ and permeability measured perpendicular or substantially perpendicular to the formation bed boundaries, which may be referred to as vertical permeability, hereinafter defined $k_v$. Such permeability anisotropy is referred to as two-dimensional (hereinafter "2D") anisotropy. In some cases, there may be anisotropy within the plane parallel or substantially parallel to the formation bed boundaries, such that instead of a single value of horizontal permeability, directions, such as for example x- and y-directions, referred to as $k_x$ and $k_y$ respectively are present. Rock that exhibits variation in permeability when measured vertically or substantially vertically, as well as, both horizontal or substantially horizontal directions is said to have three-dimensional (hereinafter "3D") anisotropy. Soils or rock that exhibits no directional variation in permeability is referred to as "isotropic". "Mobility" is a measure of permeability divided by the viscosity of the fluid.

Figure 1A:
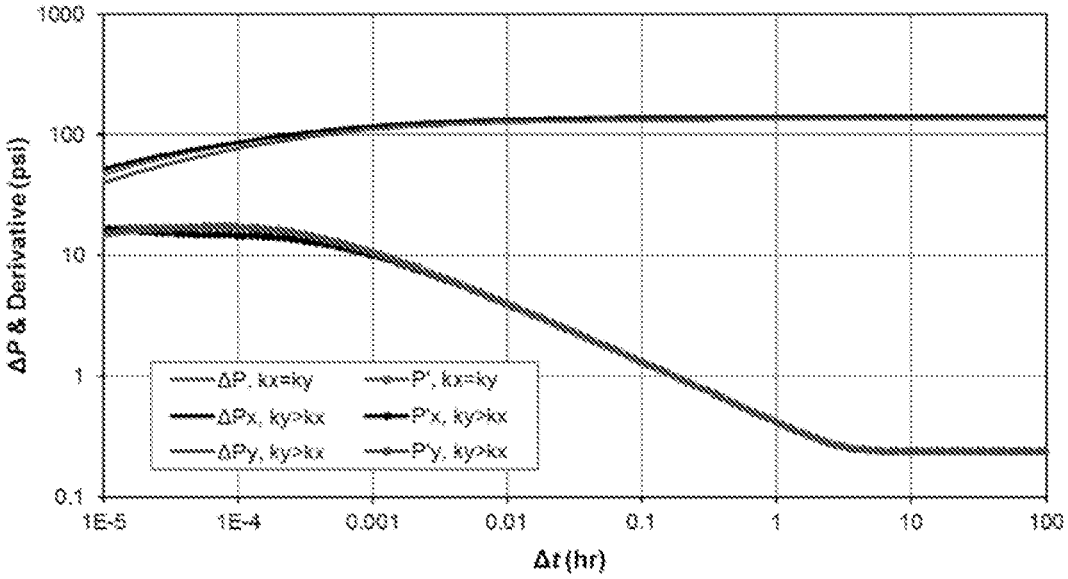
FIG. 1A is a graph showing pressure change (ΔP) and derivative results in pounds per square inch versus change in time Δt in hours on a log-log scale for a scenario of four (4) drains flowing measured at flowing drains of a four (4) port packer module testing for horizontal permeability anisotropy.
Figure 1B:
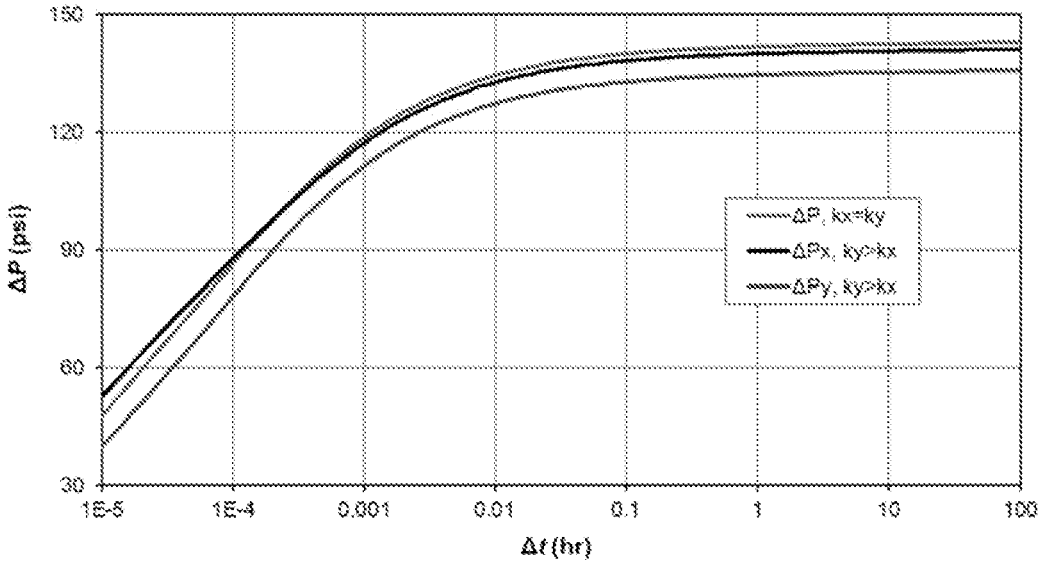
FIG. 1B is a graph showing pressure change (ΔP) in pounds per square inch versus change in time Δt in hours on a semilog scale for a scenario of four (4) drains flowing measured at flowing drains of a four (4) port packer module testing for horizontal permeability anisotropy.
Figure 1C:
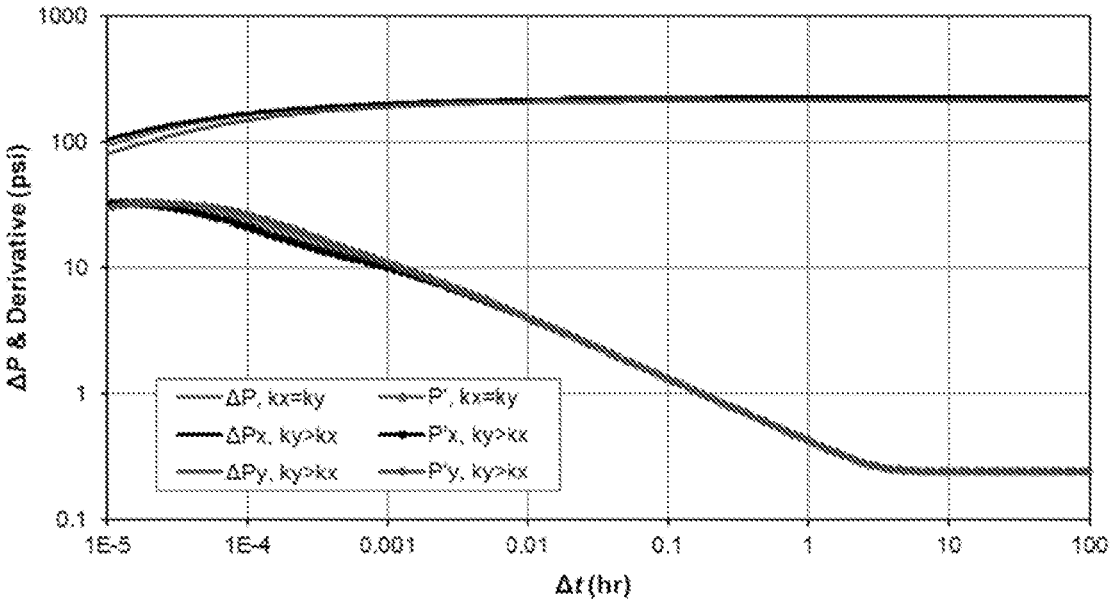
FIG. 1C is a graph displaying pressure change (ΔP) and derivative results in pounds per square inch versus change in time Δt in hours on a log-log scale for a scenario of two (2) drains flowing measured at flowing drains of a four (4) port packer module testing for horizontal permeability anisotropy.
Figure 1D:
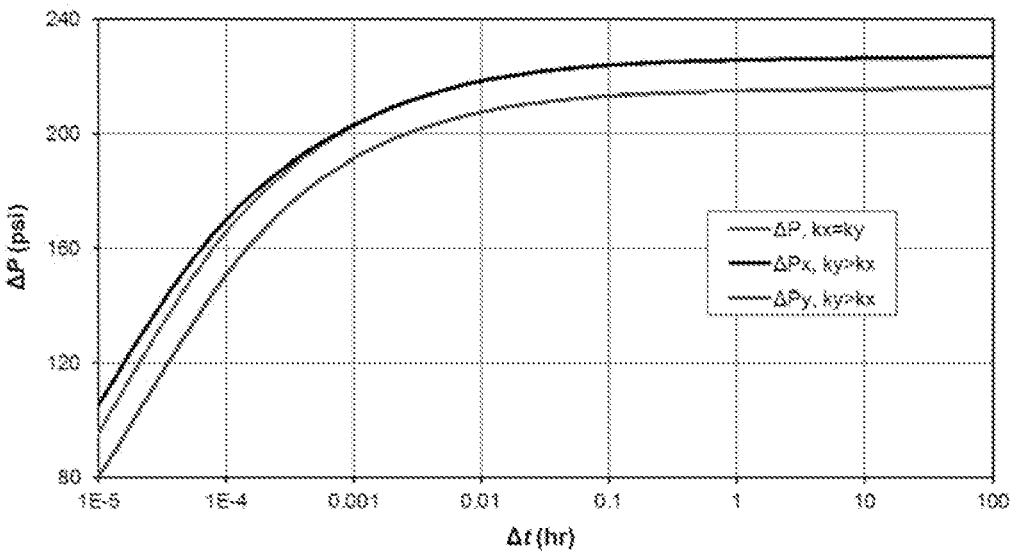
FIG. 1D is graph displaying pressure change (ΔP) in pounds per square inch versus change in time Δt in hours on a semilog scale for a scenario of two (2) opposite drains flowing measured at flowing drains of a four (4) port packer module testing for horizontal permeability anisotropy.
Figure 1E:
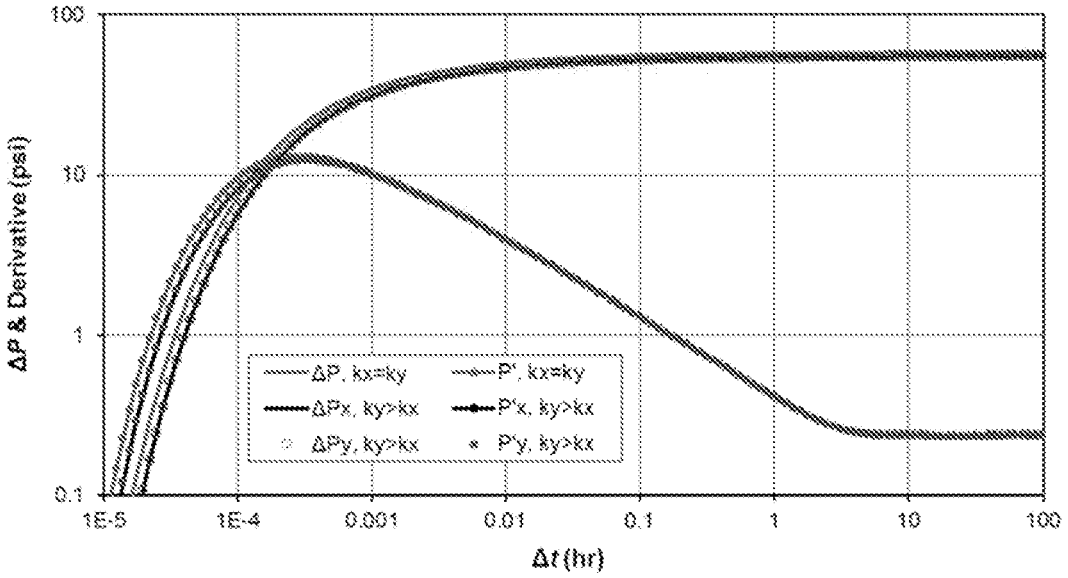
FIG. 1E is a graph displaying pressure change (ΔP) and derivative results in pounds per square inch versus change in time Δt in hours on a log-log scale for a scenario of two (2) opposite drains flowing measured at flowing drains of a four (4) port packer module testing for horizontal permeability anisotropy.
Figure 1F:
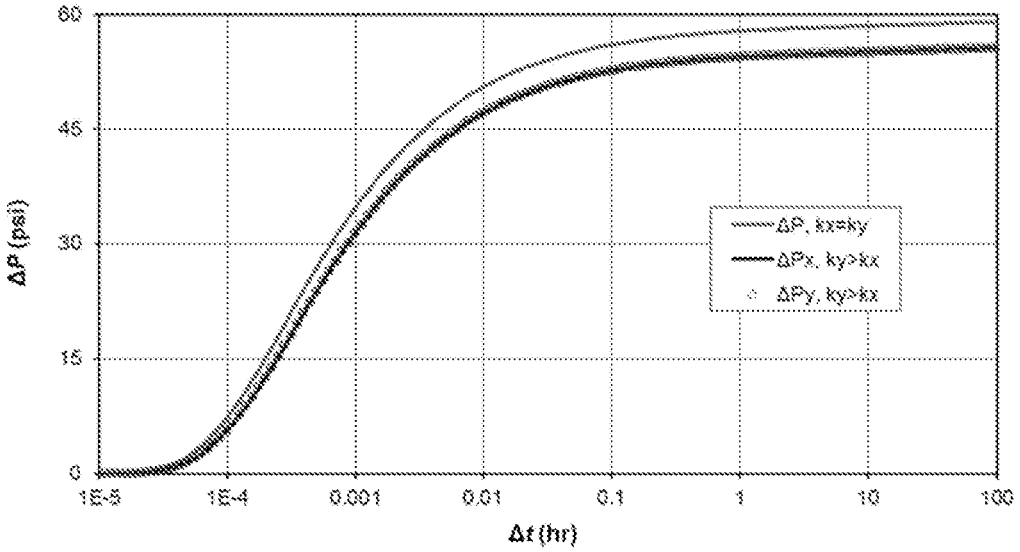
FIG. 1F is a pressure change (ΔP) in pounds per square inch versus change in time Δt in hours on a semilog scale for a scenario of two (2) opposite drains flowing measured at observation drains of a four (4) port packer module testing for horizontal permeability anisotropy.

FIG. 1A shows the pressure change and derivative results on a log-log scale for all four (4) drains flowing of a single-packer system that is deployed in a wellbore. FIGS. 1A through 1F and 2A through 2C, the drains are aligned with anisotropy. FIG. 1B presents the pressure change results on a semilog scale. There is some sensitivity to horizontal anisotropy, however, the values show a constant offset of the value of change in pressure (ΔP). It may not be concluded, therefore if $k_y>k_x$ or if one/both of the x-direction drains have some skin damage relative to the y-direction drains. In the values shown, $\Delta P_x$ is lower than $\Delta P_{isotropic}$ after a few seconds when $k_y>k_x$. This implies that even when facing the lower permeability ($k_x$), the x-direction drains are influenced by the higher permeability ($k_y$). Both anisotropic cases would yield negative skin if interpreted with an isotropic model.

FIGS. 1C through 1F display the results for two opposite-drains flowing. The responses at the flowing drains (FIGS. 1C and 1D) show sensitivity to horizontal anisotropy and are similar to the four (4) drain flowing cases. The responses at the observation drains (FIGS. 1E and 1F) show sensitivity to anisotropy; these drains are not affected by skin so the responses would be clear evidence of anisotropy. The anisotropic responses for the x- and y-direction drains, however are nearly identical. Thus, the observation drains allow detection of horizontal anisotropy and quantification of the component values, but it would not be possible to determine which component value is $k_x$ and which is $k_y$.

Figure 2A:
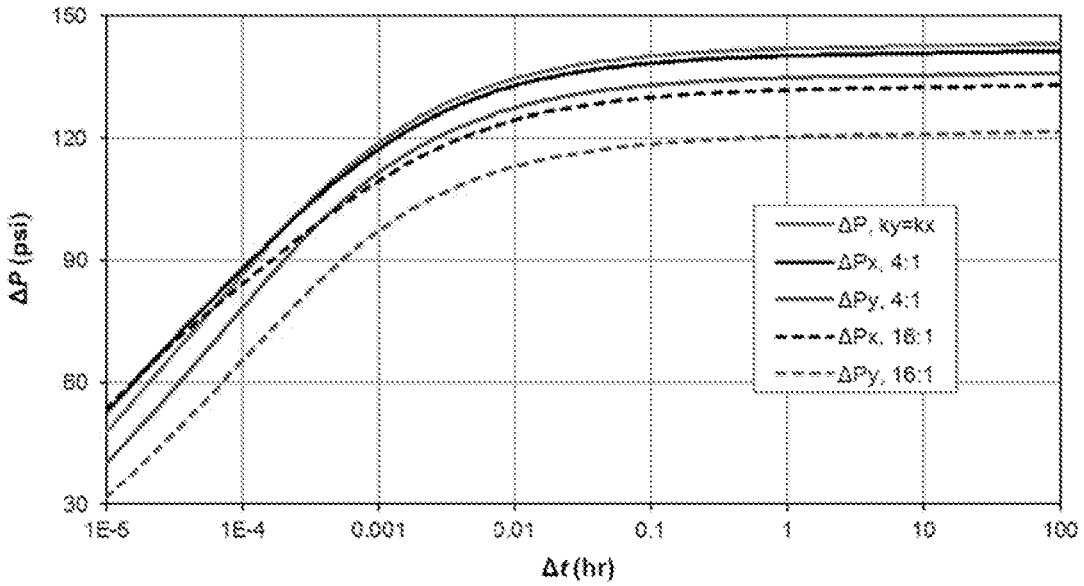
FIG. 2A is a graph of pressure change (ΔP) in pounds per square inch versus change in time Δt in hours on a semilog scale for a scenario of four (4) drains flowing measured at flowing drains of a four (4) port packer module testing for horizontal permeability anisotropy wherein $k_y/k_x$=1, 4 and 16.

A second set of cases, with larger anisotropy, was considered: $k_x$=2.5 with $k_y$=40 millidarcy and $k_x$=40 with $k_y$=2.5 millidarcy. The results are similar to those of FIGS. 1A through 1F. To summarize the results, FIGS. 2A through 2C display the semilog pressure responses for all cases of the drains aligned with permeability. FIG. 2A shows that when all four (4) drains are flowing there is sensitivity to the magnitude and direction of horizontal anisotropy; however the values determined look like a skin effect. All anisotropic cases would yield negative skin if interpreted with an isotropic model regardless of the direction of anisotropy. As anisotropy grows, for example, the negative skin becomes larger. In FIG. 2A, the change in pressure (ΔP) in pounds per square inch ranges from a low value of approximately thirty (30) pounds per square inch to a high value of one hundred forty (140) pounds per square inch. For the x ordinate, the change in time from the start of sampling Δt in hours ranges up to one hundred (100) hours. As can be seen for the various plots of $k_y/k_x$ for the values of 1, 4 and 16, values of change in pressure increase up to approximately 0.01 hour and then tend to flatten after that elapsed time period.

Figure 2B:
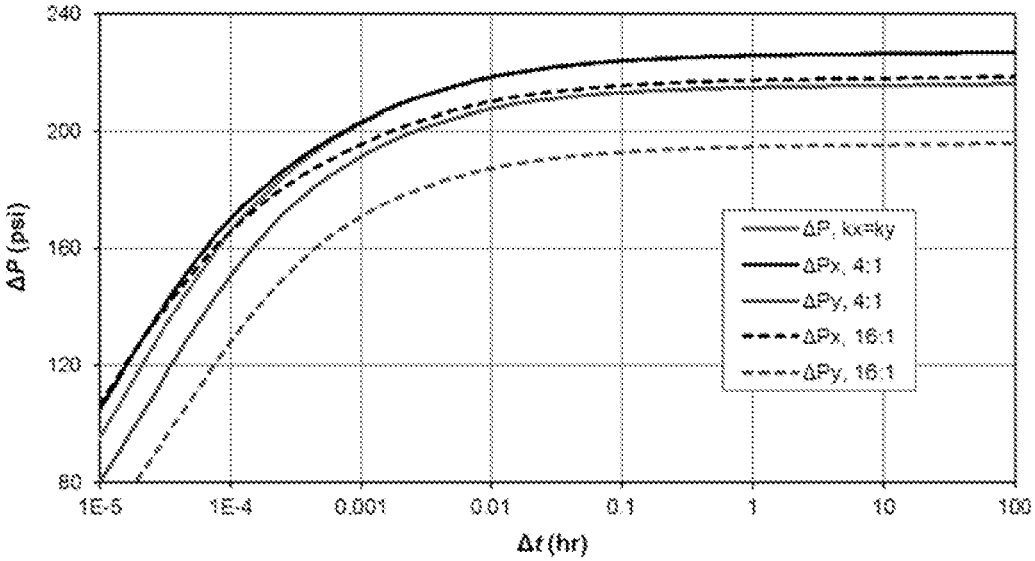
FIG. 2B is a graph of pressure change (ΔP) in pounds per square inch versus change in time Δt in hours on a semilog scale for a scenario of two (2) opposite drains flowing measured at flowing drains of a four (4) port packer module testing for horizontal permeability anisotropy with $k_y/k_x$=1, 4 and 16.

FIG. 2B shows that when two opposite-drains flow, the response at the flowing drains show sensitivity to horizontal anisotropy at the x-direction and y-direction drains. The responses are similar to the four (4) drains flowing cases.

Figure 2C:
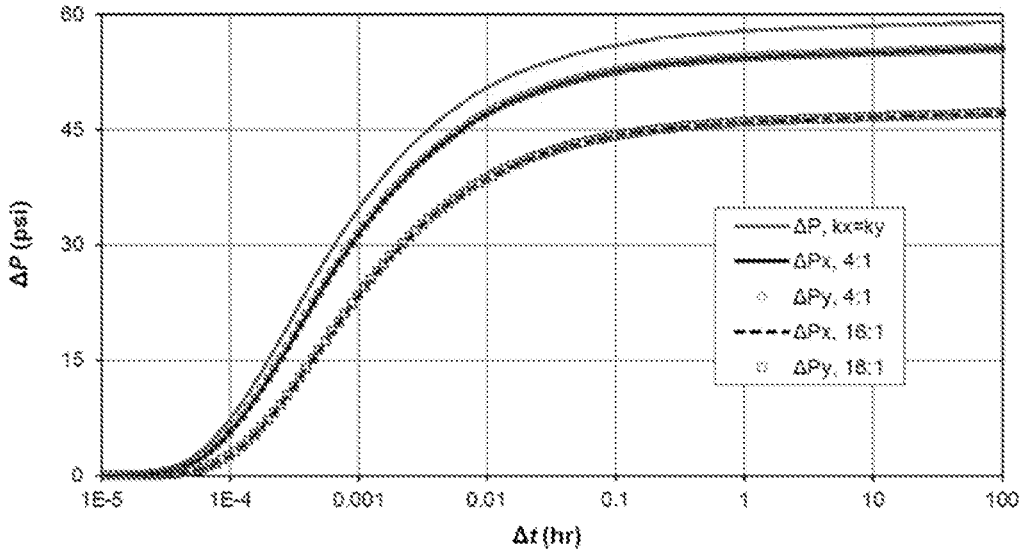
FIG. 2C is a graph of pressure change (ΔP) in pounds per square inch versus change in time (Δt) in hours on a semilog scale for a scenario of two (2) opposite drains flowing measured at observation drains of a four (4) port packer module testing for horizontal permeability anisotropy wherein $k_y/k_x$=1, 4 and 16.

FIG. 2C shows that when two (2) opposite drains flow, the responses at the observation drains show sensitivity to anisotropy. The observation drains are not affected by skin so the responses would be clear evidence of anisotropy. The anisotropic responses for the x- and y-direction drains, however, are nearly identical. The observation drains allow for the determination of the magnitude of horizontal anisotropy but not the direction (i.e. cannot determine if $k_y>k_x$ or $k_x>k_y$).

The port numbers for the all FIGS. 1 through 4 are numbered as port number 1 which relates to drain number 1, port number 2 which relates to drain number 2, port number 3 which relates to drain number 3 and port number 4 which relates to drain number 4. As will be understood, and used throughout the specification, the value of one darcy is referenced to a mixture of unit systems wherein a permeability of 1 darcy permits a flow of 1 $cm^3/s$ of a fluid with viscosity of 1 cP wherein 1 P=1 gram $cm^{-1}$ $s^{-1}$. Permeability values range from as high as 1000000 darcys for gravel to less than 0.01 microdarcy for hard stones such as granite.

Figure 3A:
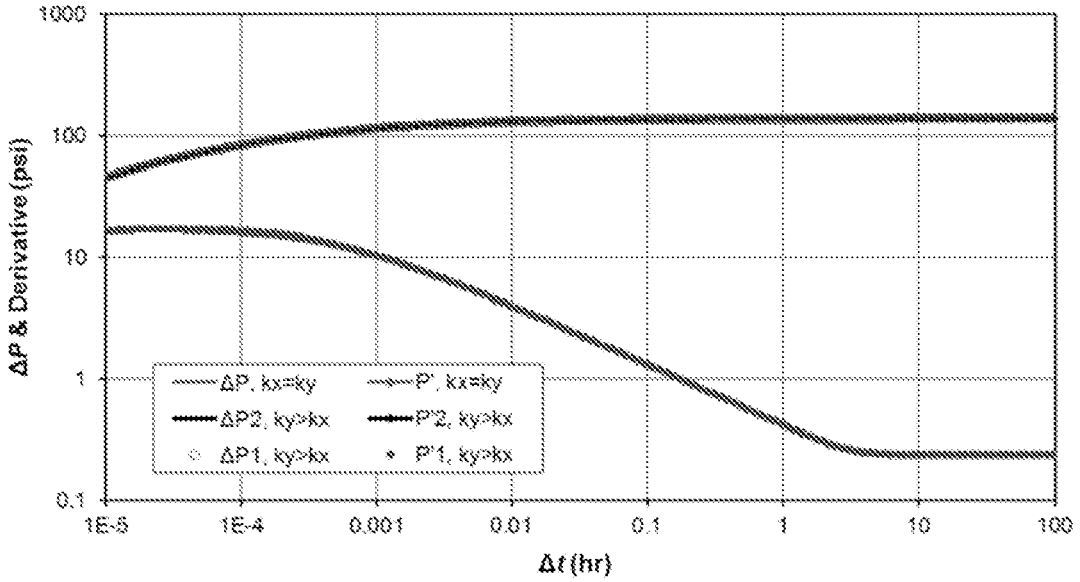
FIG. 3A is graph of pressure change (ΔP) and derivative results in pounds per square inch versus change in time (Δt) in hours on a log-log scale for a scenario of four (4) drains flowing measured at flowing drains of a four (4) port packer module testing for horizontal permeability anisotropy.
Figure 3B:
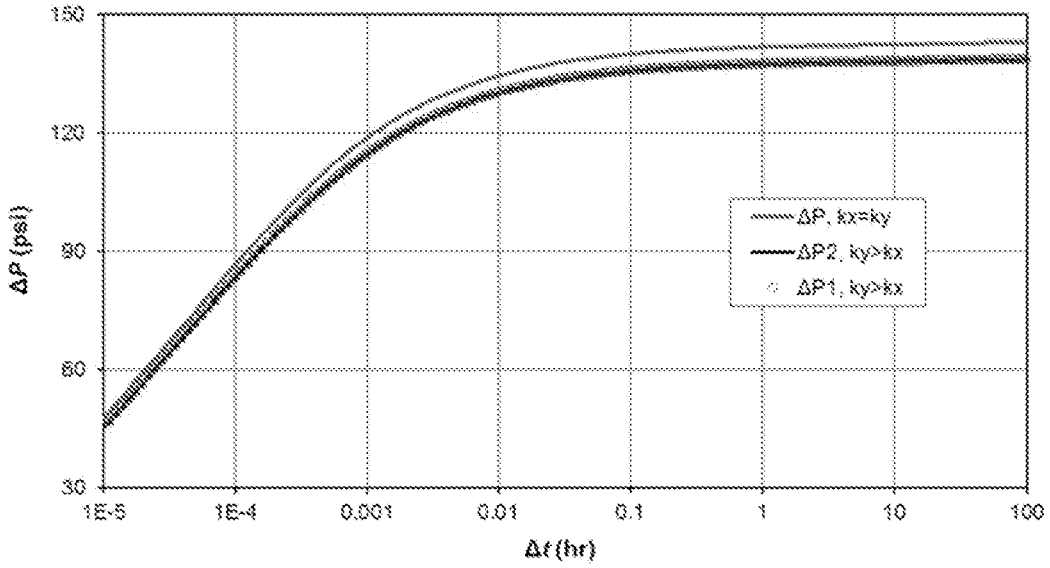
FIG. 3B is a graph of pressure change (ΔP) results in pounds per square inch versus change in time (Δt) in hours on a semilog scale for a scenario of four (4) drains flowing measured at flowing drains of a four (4) port packer module testing for horizontal permeability anisotropy.
Figure 3C:
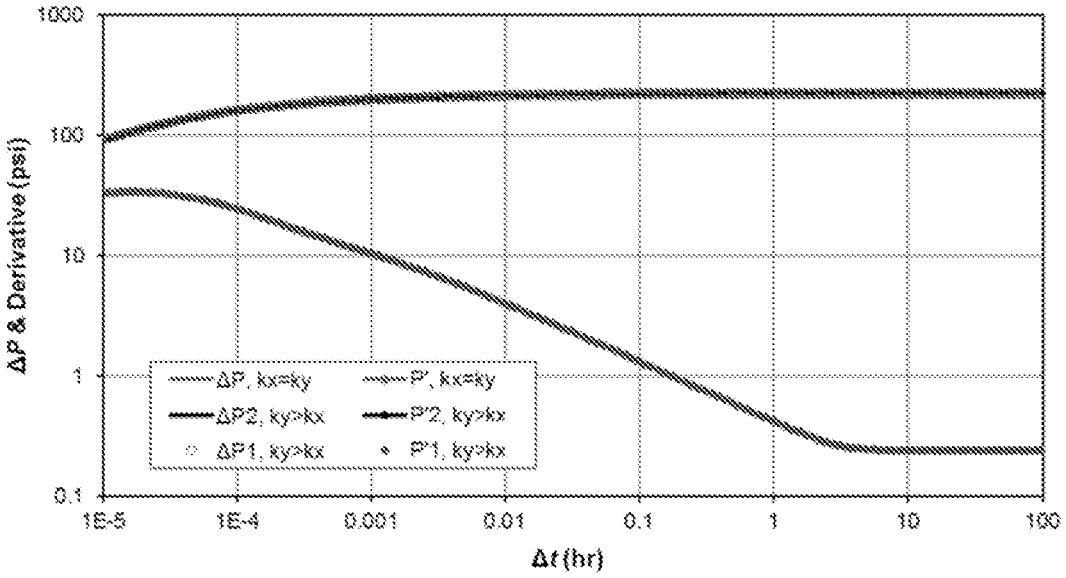
FIG. 3 is a graph of pressure change (ΔP) a derivative results in pounds per square inch versus change in time (Δt) in hours on a log-log scale for a scenario of two (2) opposite drains flowing measured at flowing drains of a four (4) port packer module testing for horizontal permeability anisotropy.
FIG. 3D is a graph pressure change (ΔP) results in pounds per square inch versus change in time (Δt) in hours on a semilog scale for a scenario of two (2) opposite drains flowing measured at flowing drains of a four (4) port packer module testing for horizontal permeability anisotropy.
FIG. 3E is a graph of pressure change (ΔP) and derivative results in pounds per square inch versus change in time (Δt) in hours on a log-log scale for a scenario of two (2) opposite drains flowing measured at observation drains of a four (4) port packer module testing for horizontal permeability anisotropy.
FIG. 3F is a graph of pressure change (ΔP) and derivative results in pounds per square inch versus change in time (Δt) in hours on a semilog scale for a scenario of two (2) opposite drains flowing measured at observation drains of a four (4) port packer module testing for horizontal permeability anisotropy.
Figure 3D:
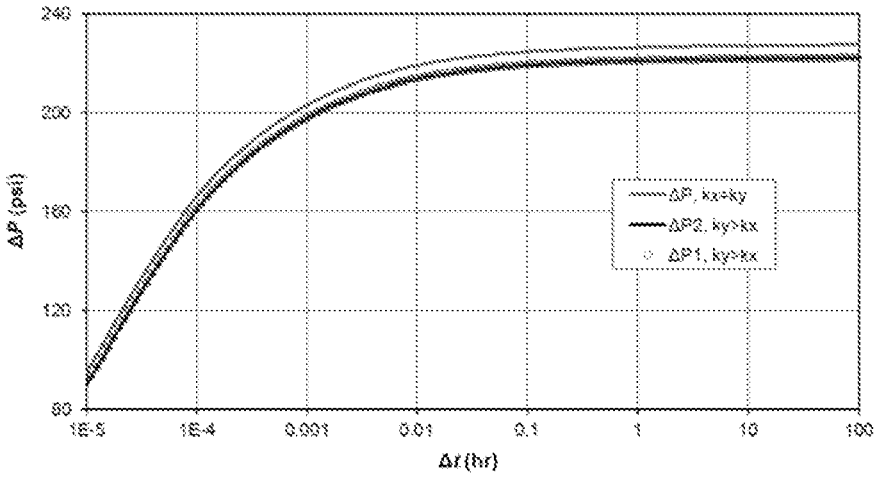
Figure 3E:
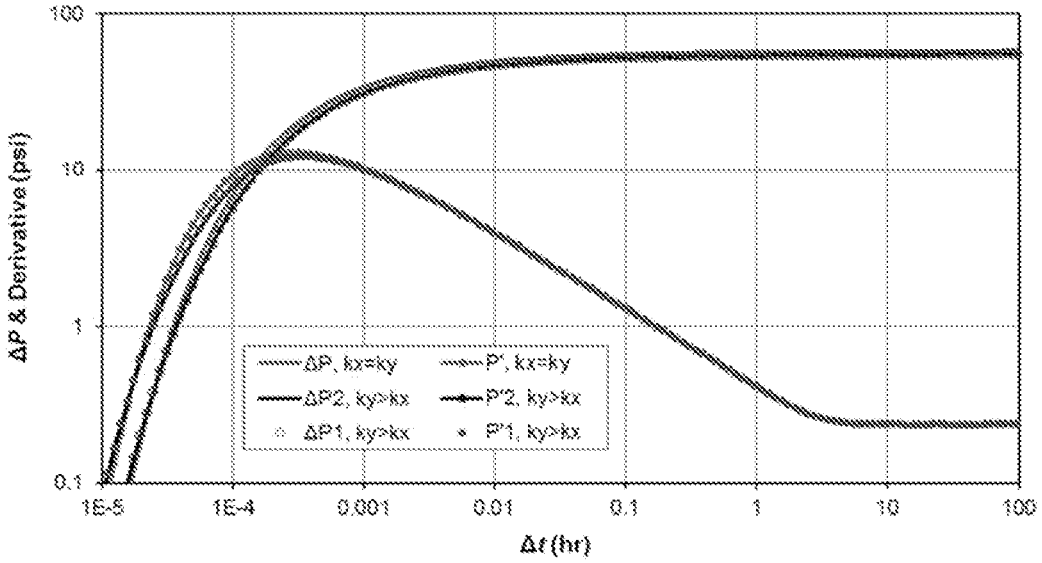
Figure 3F:
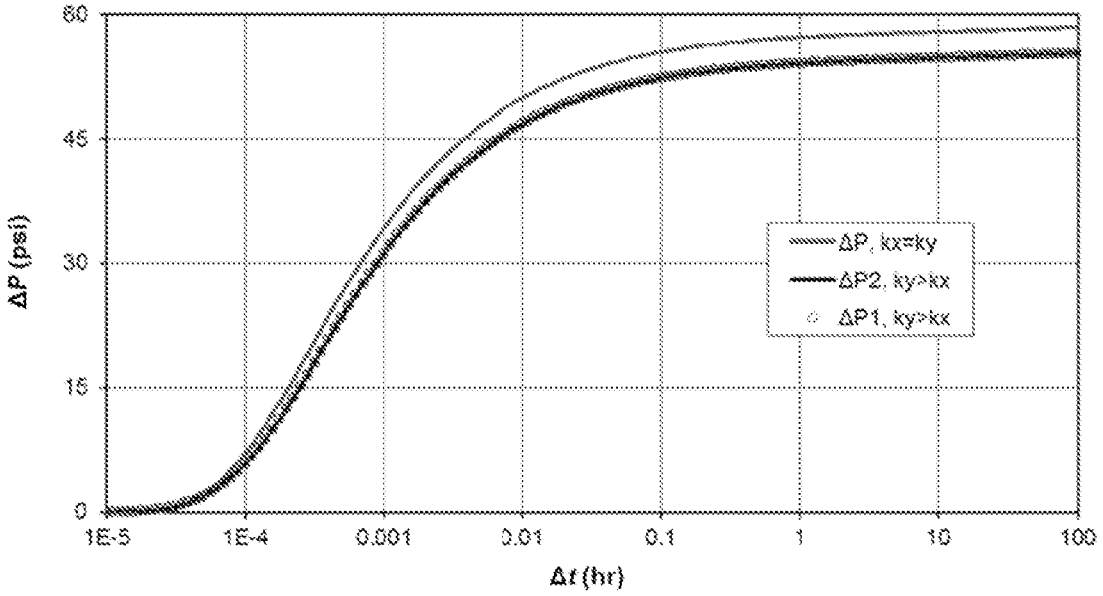

FIGS. 3A and 3B illustrate examples when four (4) drains are flowing. For FIGS. 3A through F and 4A through 4*c*, the drains are aligned at 45 degrees with respect to horizontal anisotropy. FIG. 3A presents the results on a log-log scale while FIG. 3B illustrates the results on a semilog scale. As presented, there is some sensitivity to the magnitude of horizontal anisotropy, but the results indicate a constant offset of ΔP. There is an absence of sensitivity to the direction of anisotropy, wherein the responses at all drains are identical and the responses for $k_y/k_x$=4 and $k_y/k_x$=¼ are identical. FIGS. 3C through 3F display the results for two opposite drains flowing. The responses at the flowing drains (FIGS. 3C and 3D) show sensitivity to horizontal anisotropy and are similar to the four drains flowing cases. The responses at the observation drains (FIGS. 3*e* and 3F) show sensitivity to anisotropy and are not affected by skin so the responses would be clear evidence of anisotropy. The anisotropic responses for all drains are identical. This, the observation drains would allow detection of horizontal anisotropy and quantification of the component values, but it would not be possible to determine which component value $k_x$ and which is $k_y$.

A second set of cases, pith larger anisotropy, was considered: $k_x$=2.5 with $k_y$=40 millidarcy and $k_x$=40 with $k_y$=2.5 millidarcy. The results are similar to those of FIGS. 3A through 3F. To summarize the results, FIGS. 4A through 4C display the semilog pressure responses for all cases of the drains oriented at 45 degrees with respect to the horizontal permeability directions.

Figure 4A:
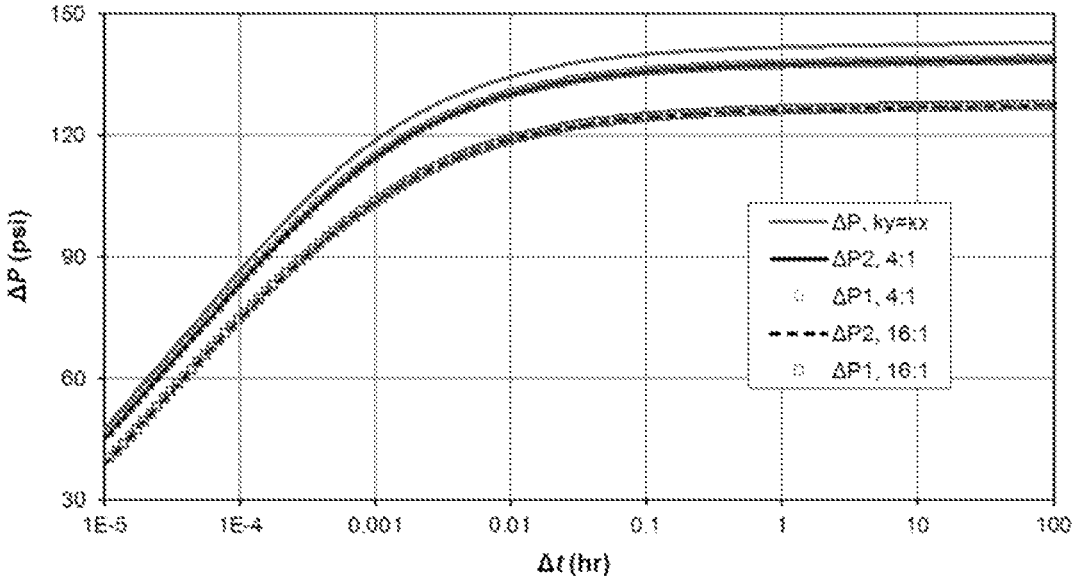
FIG. 4A is a graph of pressure change (ΔP) in pounds per square inch versus change in time (Δt) in hours on a semilog scale for a scenario of four (4) drains flowing measured at flowing drains of a four (4) port packer module testing for horizontal permeability anisotropy wherein $k_y/k_x$=1, 4 and 16.

Referring to FIG. 4A, a graph is illustrated wherein the change of pressure, ΔP, in pounds per square in inch is provided in the Y axis and a change in time, ΔP, in hours, is provided. FIG. 4A illustrates the change in pressure, ΔP at flowing drains, when all four (4) drains are flowing. Three different cases are provided, wherein $k_x=k_y$, and $k_y/k_x$=4 or $k_y/k_x$=16. As illustrated, values for change in pressure (ΔP) in pounds per square inch range from zero (0) to near one hundred fifty (150) pounds per square inch. This occurs over a change in time period of approximately one hundred (100) hours. For all cases, of $k_y/k_x$ values for change in pressure start to flatten at approximately 0.01 our (approximately three hundred sixty (360) seconds). The maximum change in pressure in pounds per square inch is approximately 140 pounds per square inch. For the cases where $k_x=k_y$, the values for $k_x$ and $k_y$ chosen for evaluation were ten (10) millidarcy. For the cases where $k_y/k_x$=4 and 16, the values for $k_x$ are first at five (5) millidarcy then 2.5 millidarcy and the values of $k_y$=twenty (20) millidarcy and forty (40) millidarcy accordingly.

Figure 4B:
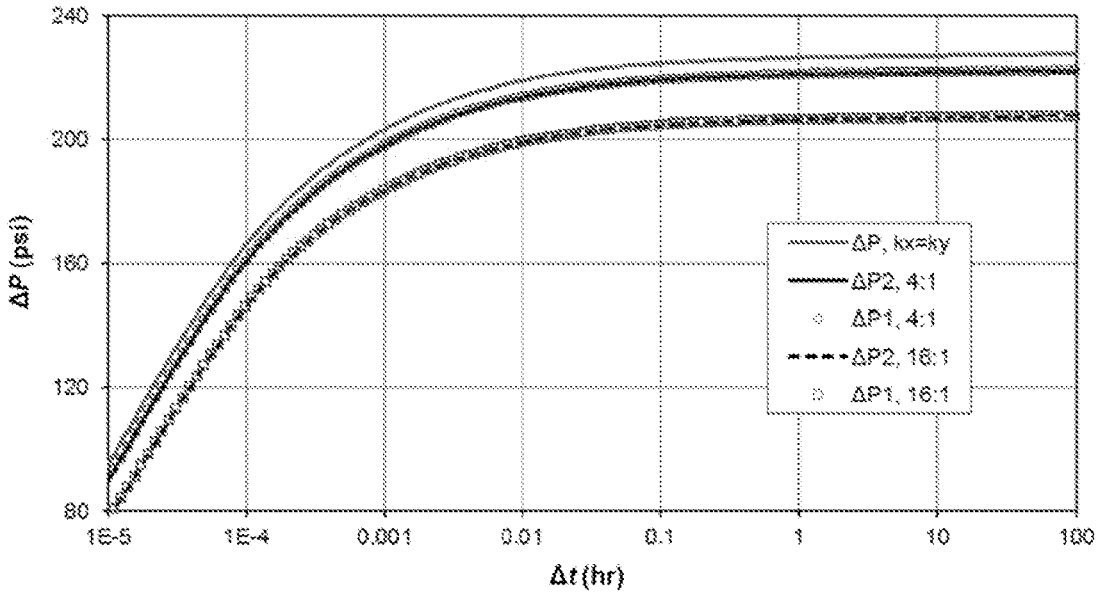
FIG. 4B is a graph of pressure change (ΔP) in pounds per square inch versus change in time (Δt) in hours on a semilog scale for a scenario of two (2) opposite drains flowing measured at flowing drains of a four (4) port packer module testing for horizontal permeability anisotropy wherein $k_y/k_x$=1, 4 and 16.

Referring to FIG. 4B, a graph is illustrated wherein the change of pressure ΔP in pounds per square in inch is provided in the Y axis and a change in time, in hours, is provided wherein the change in pressure is at flowing drains (not observation drains as will be described below in conjunction with FIG. 4C). FIG. 4B shows that when two opposite drains flow, the responses at the flowing drains show sensitivity to the magnitude of horizontal anisotropy. Three different cases are provided, wherein $k_x=k_y$, and $k_y/k_x$=4 or $k_y/k_x$=16. As illustrated, values for change in pressure (ΔP) in pounds per square inch range from zero (0) to near two hundred forty (240) pounds per square inch. This occurs over a change in time period of approximately one hundred (100) hours. For all cases, of $k_y/k_x$ values for change in pressure start to flatten at approximately 0.01 hours (approximately 36 seconds). The maximum change in pressure in pounds per square inch is approximately two hundred thirty (230) pout s per square inch. For the cases where $k_x=k_y$, the values for $k_x$ and $k_y$ chosen for evaluation were ten (10) millidarcy. For the cases where $k_y/k_x$=4 and 16, the values for $k_x$ are first at five (5) millidarcy then 2.5 millidarcy and the values of $k_y$=twenty (20) millidaroy and forty (40) millidarcy accordingly.

Figure 4C:
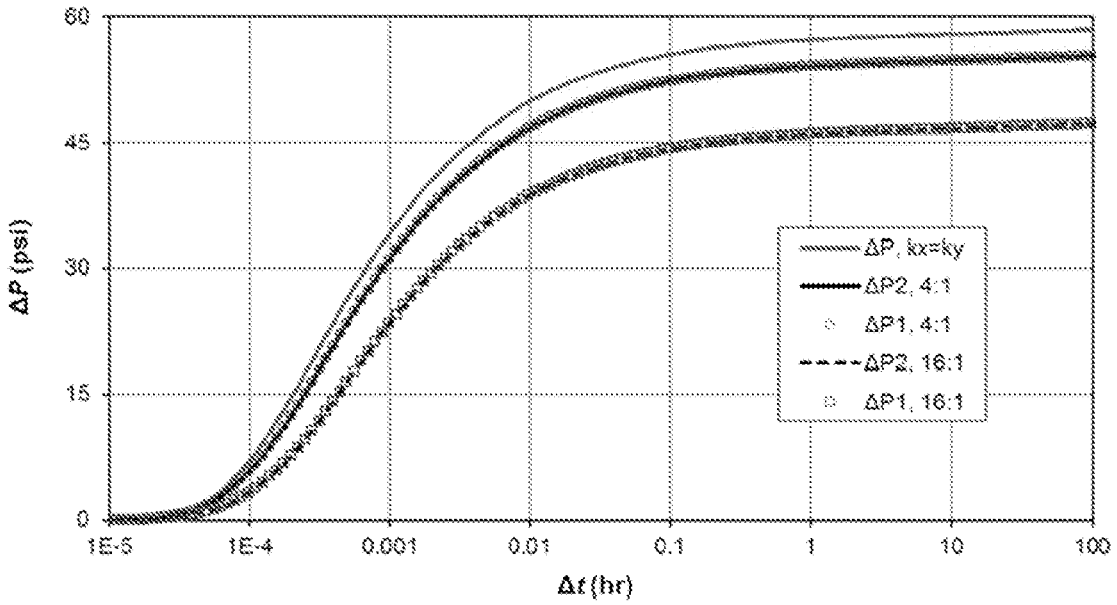
FIG. 4C is a graph of pressure change (ΔP) in pounds per square inch versus change in time (Δt) in hours on a semilog scale for a scenario of two (2) opposite drains flowing measured at observations drains of a four (4) port packer module testing for horizontal permeability anisotropy wherein $k_y/k_x$=1, 4 and 16.

Referring to FIG. 4C, a graph is illustrated wherein the change of pressure (ΔP), in pounds per square inch is provided in the Y axis and a change in time Δt, in hours, is provided in the X axis wherein the change is pressure is different than in FIG. 4B as the change in pressure is at observations drains when two opposite drains are flowing. In this case, two (2) opposite drains flow and the responses at the observations drains show sensitivity to the magnitude of horizontal anisotropy. Three different cases are provided, wherein $k_x$=$k_y$, and $k_y/k_x$=4 or $k_y/k_x$=16. As illustrated, values for change in pressure (ΔP) in pounds per square inch range from zero (0) to near sixty (60) pounds per square inch. This occurs over a change in time period of approximately one hundred (100) hours. For all cases, of $k_y/k_x$ values for change in pressure start to flatten at approximately 0.01 hours (approximately 36 seconds). For the cases where $k_x$=$k_y$, the values for $k_x$ and $k_y$ chosen for evaluation were ten (10) millidarcy. For the cases where $k_y/k_x$=4 and 16, the values for $k_x$ are first at five (5) millidarcy then 2.5 millidarcy and the values of $k_y$=twenty (20) millidarcy and (40) millidarcy accordingly.

Figure 5:
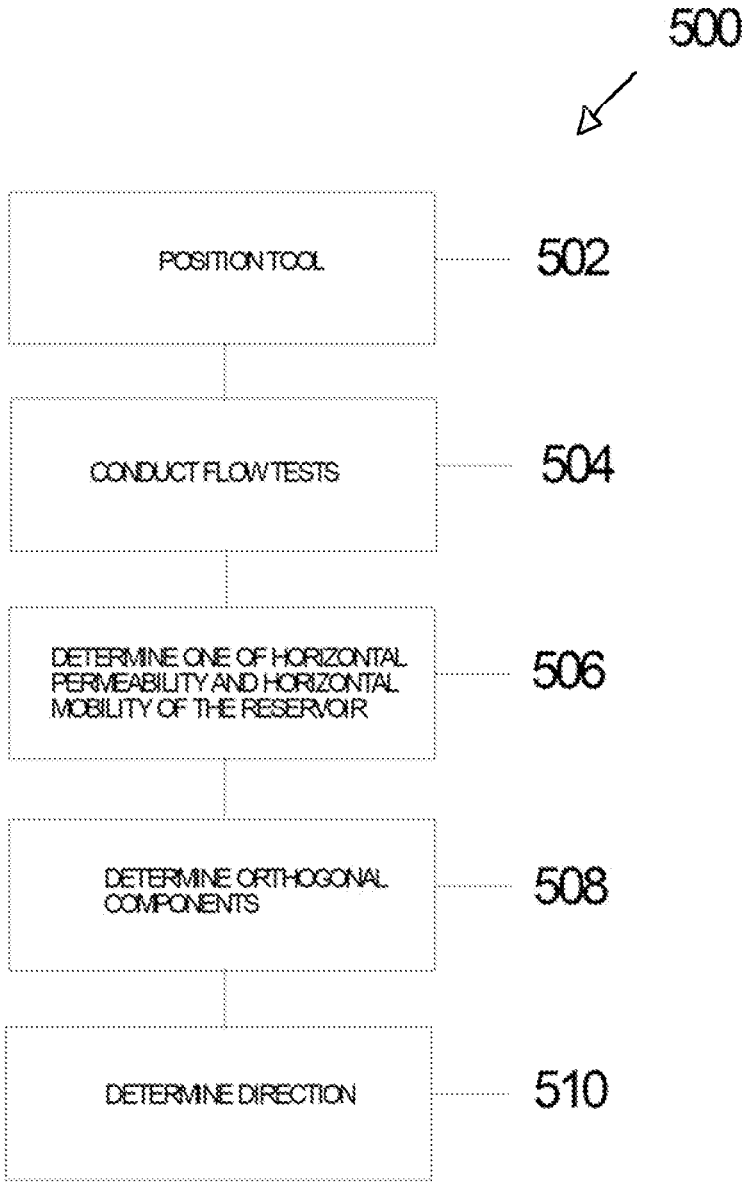
FIG. 5 is a flowchart for a method for detection of permeability anisotropy in the horizontal plane of a single packer.

Referring to FIG. 5, a method 500 for detection of permeability anisotropy is disclosed. The method 500, comprises positioning a formation testing tool within a wellbore formed within a subsurface reservoir 502 and conducting a series of three flow tests with the testing tool wherein a first test is a four drain flow test, a second test is a pair of opposite drains flowing on diametrically opposite sides of the formation testing tool and a third test is a second pair of opposite drains flowing on opposite drains different than the second test 504. The method also comprises determining one of horizontal permeability and horizontal mobility of the reservoir based on measuring a flow response of the subsurface reservoir one of at and adjacent to the flowing drains 606 and determining one of orthogonal components of horizontal permeability and horizontal mobility based on the measured flow response 508. The method 500 may also comprise determining a direction of the orthogonal components of one of the horizontal permeability and horizontal mobility with respect to the orientation of the formation testing tool based on a measured flow response 510.

While the aspects have been described with respect to a limited number of embodiments, those skilled in the art, having benefit of this disclosure, will appreciate that other embodiments can be devised which do not depart from the scope of the invention as disclosed herein.

What is claimed is:

1. A method comprising:

positioning a formation testing tool within a wellbore formed within a subsurface reservoir, wherein the formation testing tool comprises a first pair of opposite drains disposed on diametrically opposite sides of the formation testing tool and a second pair of opposite drains disposed on diametrically opposite sides of the formation testing tool different from the diametrically opposite sides of the first pair of opposite drains, and the first and second pairs of opposite drains are disposed around a periphery of the formation testing tool;

sensing a first set of pressure values versus time at both the first and second pairs of opposite drains during a first test;

sensing a second set pressure values versus time at only the first pair of opposite drains during a second test; and sensing a third set of pressure values versus time at only the second pair of opposite drains during a third test.

2. The method according to claim 1, wherein the formation testing tool is configured with a single-packer module.

3. The method according to claim 2, wherein the single-packer module comprises the first and second pairs of opposite drains, and the first second pairs of opposite drains comprise four symmetrically shaped drains to enable fluid communication with the subsurface reservoir.

4. The method according to claim 1, wherein the method is performed in a sub-sea wellbore.

5. The method according to claim 1, wherein the first, second, and third tests comprise using a single-packer module in the subsurface reservoir and expanding the single-packer module to exterior sides of the wellbore.

6. An article of manufacture comprising:

a non-volatile memory configured to store a series of processor-executable commands, wherein the executable commands are configured to perform a method comprising:

positioning a formation testing tool within a wellbore formed within a subsurface reservoir, wherein the formation testing tool comprises a first pair of opposite drains disposed on diametrically opposite sides of the formation testing tool and a second pair of opposite drains disposed on diametrically opposite sides of the formation testing tool different from the diametrically opposite sides of the first pair of opposite drains, and the first and second pairs of opposite drains are disposed around a periphery of the formation testing tool;

sensing a first set of pressure values versus time at both the first and second pairs of opposite drains during a first test;

sensing a second set pressure values versus time at only the first pair of opposite drains during a second test; and sensing a third set of pressure values versus time at only the second pair of opposite drains during a third test.

7. The article of manufacture according to claim 6, wherein the formation testing tool is configured with a single-packer module.

8. The article of manufacture according to claim 7, wherein the single-packer module comprises the first and second pairs of opposite drains, and the first second pairs of opposite drains comprise four symmetrically shaped drains to enable fluid communication with the subsurface reservoir.

9. The article of manufacture according to claim 6, wherein the method is performed in a sub-sea wellbore.

10. The article of manufacture according to claim 6, wherein the first, second, and third tests comprise using a single-packer module in the subsurface reservoir and expanding the single-packer module to exterior sides of the wellbore.

* * * * *